US010178896B1

(12) United States Patent
Huang

(10) Patent No.: US 10,178,896 B1
(45) Date of Patent: Jan. 15, 2019

(54) PRESS CONTROL KEY RING

(71) Applicant: HOEY CO., LTD., Taoyuan (TW)

(72) Inventor: Joseph Huang, Taoyuan (TW)

(73) Assignee: HOEY CO., LTD., Taoyuan (TW)

( * ) Notice: Subject to any disclaimer, the term of this patent is extended or adjusted under 35 U.S.C. 154(b) by 0 days.

(21) Appl. No.: 15/869,991

(22) Filed: Jan. 12, 2018

(51) Int. Cl.
*A44B 15/00* (2006.01)
*A45F 5/02* (2006.01)
*A45F 5/00* (2006.01)

(52) U.S. Cl.
CPC ..... *A44B 15/007* (2013.01); *A44B 15/002* (2013.01); *A45F 5/022* (2013.01); *A45F 5/004* (2013.01)

(58) Field of Classification Search
CPC ..... A44B 15/00; A44B 15/007; A44B 15/002; A44B 17/00; A44B 19/00; A44B 15/005; A45F 5/002; A45F 5/004; A45C 11/324; A45C 11/38; A45C 11/329
USPC ..... 70/456 R, 459; 24/116 A, 643
See application file for complete search history.

(56) References Cited

U.S. PATENT DOCUMENTS 1,428,678 A * 9/1922 Buchsbaum ..... A44B 15/00 24/574.1
2,307,808 A * 1/1943 Segal ..... A44B 15/00 24/115 G
2,503,211 A * 4/1950 Ormsbee ..... A44B 15/00 24/600.6
2,550,038 A * 4/1951 Brown ..... F16G 15/04 24/374
2,823,537 A * 2/1958 Segal ..... A44B 15/00 24/600.6
2,989,862 A * 6/1961 Segal ..... A44B 15/00 24/598.3
3,776,009 A * 12/1973 MacGlashan ..... A44B 15/00 70/459
4,584,858 A 4/1986 Wolter
4,821,543 A * 4/1989 Scungio ..... A44B 15/00 206/37.1
5,138,855 A * 8/1992 Faris ..... A44B 15/00 24/674
5,528,916 A * 6/1996 Song ..... A44B 15/00 24/598.3
6,763,692 B1 * 7/2004 Huang ..... A44B 15/00 24/3.6
6,848,287 B1 * 2/2005 Huang ..... A44B 15/00 24/3.6
8,407,862 B2 * 4/2013 Bluma ..... F16B 45/00 24/3.6
2004/0118173 A1 * 6/2004 Huang ..... A44B 15/00 70/456 R (Continued)

*Primary Examiner* — Suzanne L Barrett
(74) *Attorney, Agent, or Firm* — Guice Patents PLLC

(57) ABSTRACT

A press control key ring includes a split ring defining an opening between two opposite ends thereof, and a locking module including an inner casing for the insertion of the two opposite ends of the annular wire rod and having a mounting hole on the middle of the top wall thereof, an elastic member mounted in the inner casing with one end thereof secured to an inner bottom wall of the inner casing, a press block mounted in the mounting hole and supported on the opposite end of the elastic member, and an outer casing sleeved onto the inner casing and having an insertion hole on the middle of the top wall thereof for the insertion of the press block.

7 Claims, 9 Drawing Sheets

(56) References Cited

U.S. PATENT DOCUMENTS

2007/0017266 A1* 1/2007 Huang ..... A45F 5/02
70/459
2011/0314879 A1* 12/2011 Danforth, Jr. ..... A44B 15/00
70/459

* cited by examiner

PRESS CONTROL KEY RING

BACKGROUND OF THE INVENTION

1. Field of the Invention

The present invention relates to key ring technology and more particularly, to a press control key ring, which uses a simple locking module for controlling the access of the opening of a split ring, facilitating operation.

2. Description of the Related Art

As people's everyday lives get more and more convenient, most people carry several different functions of keys on the body, including the key to the door of residence, the door keys, car and motorcycle keys, the company keys and other types of keys. In order to facilitate storage and access to the keys carried by oneself, most people will use a key ring to hold the keys.

A key ring can be a simple split ring, or a double turn ring. When securing keys to a key ring, the user must open the ends of the key ring with force so that the hole in the head of each key can be coupled to the key ring. It is inconvenient to mount and dismount keys in this manner.

U.S. Pat. No. 4,584,858 discloses a device for forming a bunch of keys having a centrally arranged disc from which individual key holder members extend. Ball heads of arms of the key holder members are slidably mounted in an undercut groove in the disc which opens towards the periphery of the disc. The groove has a removal opening for the ball heads which is releasably closed by a slide such that the ball heads can move around in the groove passing by the removal opening.

The aforesaid prior art device facilitating mounting and dismounting of keys, however, its complicated structure does not facilitate fabrication and installation. Further, it can easily get stuck, making removal of loaded keys difficult.

SUMMARY OF THE INVENTION

The present invention has been accomplished under the circumstances in view. It is therefore the main object of the present invention to provide a press control key ring, which uses a simple locking module for controlling the access of the opening of a split ring, facilitating operation.

To achieve this and other objects of the present invention, a press control key ring comprises a split ring and a locking module. The split ring is formed of an annular wire rod, defining an opening between two opposite ends thereof for the insertion of a key to be held. The locking module is mounted in the opening of the split ring, and operable to close/open the opening. The locking module comprises an inner casing, an elastic member, a press block, and an outer casing. The inner casing is a hollow shell having two opposite open ends for allowing the two opposite ends of the annular wire rod to be inserted into the inner casing. The inner casing comprises a plurality of supporting blocks disposed in each of the two opposite open ends thereof for supporting sliding movement of the annular wire rod in the locking module, a mounting hole located on the middle of a top wall thereof, a plurality of retaining blocks respectively symmetrically located on two opposite inner lateral walls thereof adjacent to the mounting hole, and an engagement bottom protrusion downwardly curved from an outer bottom wall near one end thereof. The elastic member is mounted in the inner casing, having one end thereof fastened to the inner bottom wall of the inner casing. The press block is a hollow shell having two opposite open ends and mounted in the inner casing through the mounting hole with the two opposite open ends thereof disposed in communication with the inside space of the inner casing. The press block comprises a locating block downwardly protruded from a bottom wall thereof and inserted into an opposite end of the elastic member to secure the elastic member and the press block together, a plurality of side holes respectively located on two opposite sidewalls thereof and adapted to face toward the respective retaining blocks after accommodation of the press block in the inner casing. The outer casing is sleeved onto the inner casing. Further, the outer casing is a hollow shell having two opposite open ends for the insertion of the inner casing into the outer casing, comprising an insertion hole located on the middle of a top wall thereof corresponding to the mounting hole of the inner casing for the insertion of the press block, and a locating hole located on a bottom wall near one end thereof for engagement with the engagement bottom protrusion to secure the outer casing and the inner casing firmly together after insertion of the inner casing into the outer casing.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
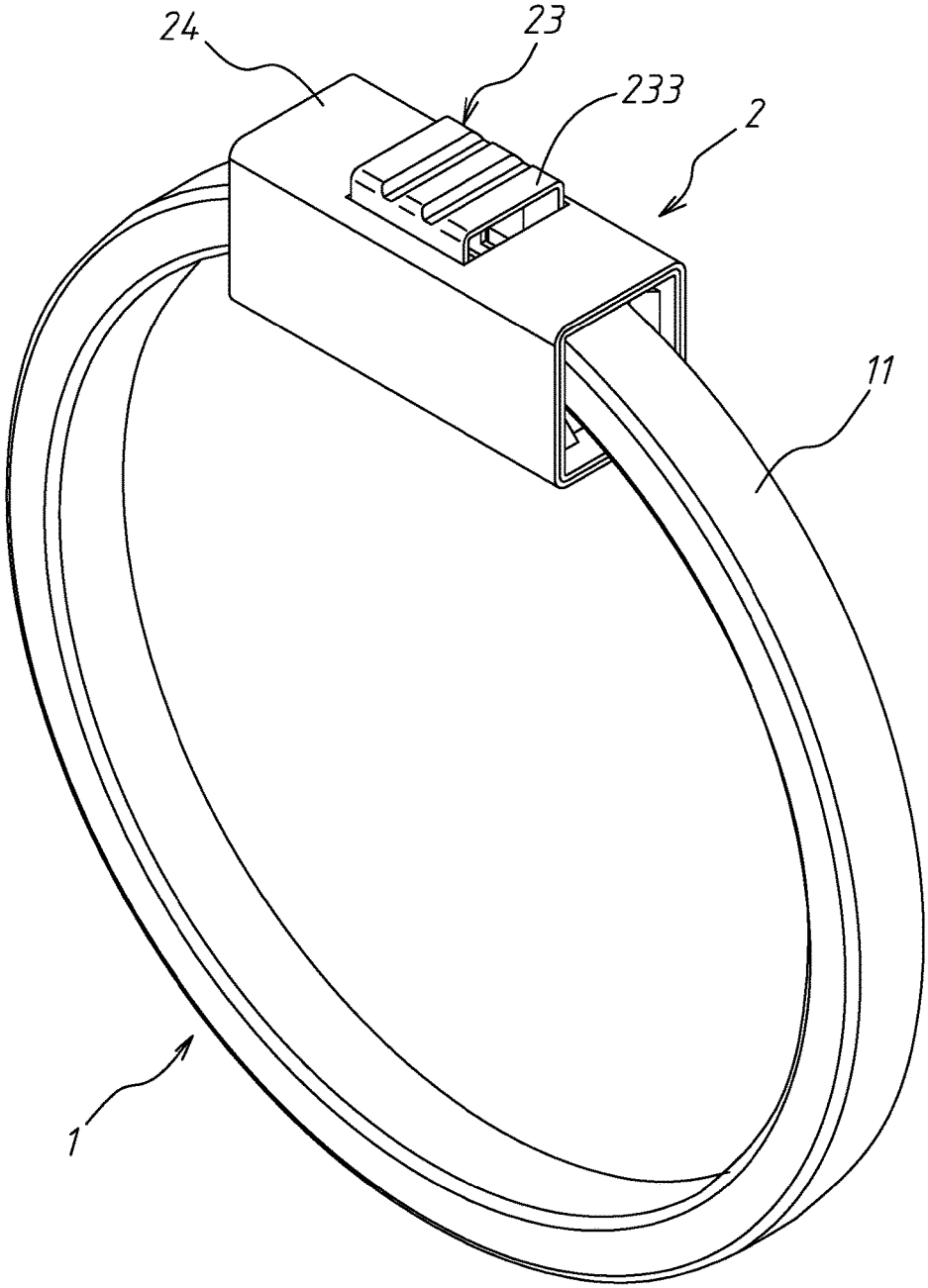
FIG. 1 is an oblique elevational view of a press control key ring in accordance with the present invention.
Figure 2:
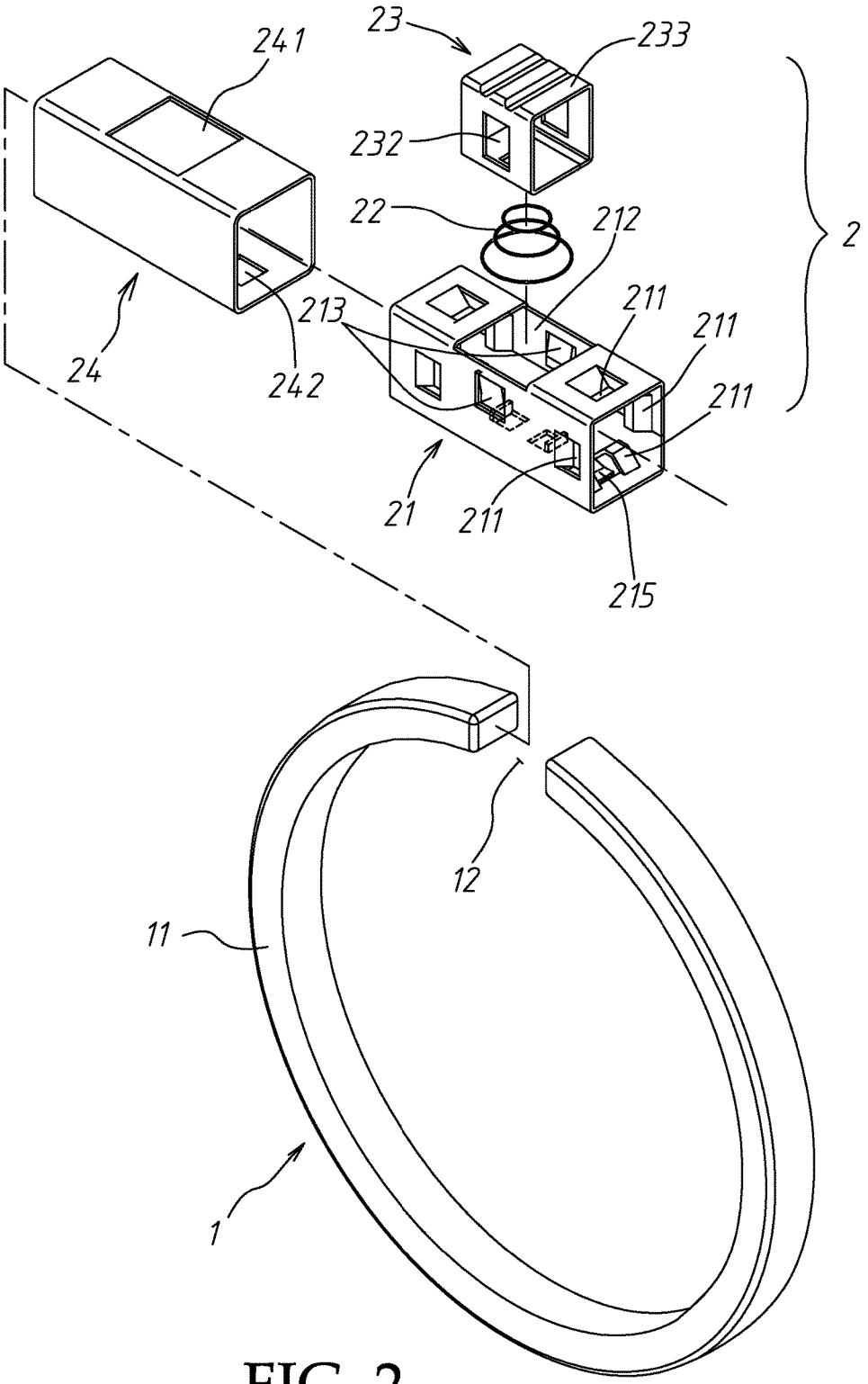
FIG. 2 is an exploded view of the press control key ring in accordance with the present invention.

Referring to FIG. 1 and FIG. 2, an elevational view and an exploded view of a press control key ring in accordance with the present invention are shown. The press control key ring comprises a split ring 1 and a locking module 2. The split ring 1 is an annular wire rod 11 with an opening 12 defined between two opposite ends thereof. In this embodiment, the annular wire rod 11 is made of a metal material, thereby strengthening the structural rigidity and bearing capacity of the split ring 1.

Referring to FIGS. 1 and 2 again, the locking module 2 is mounted in the opening 12 of the split ring 1, and operable to open or close the opening 12. The locking module 2 comprises an inner casing 21. The inner casing 21 is a rectangular hollow shell of double open end design that facilitates insertion of the two opposite ends of the annular wire rod 11 into the inside of the inner casing 21, comprising at least one, for example, multiple blocks 211 disposed in each of the two opposite ends thereof for supporting sliding movement of the annular wire rod 11 in the locking module 2, a mounting hole 212 exhibiting a rectangular shape and located on the middle of a top wall thereof, at least one, for example, two retaining blocks 213 of barbed design respectively symmetrically located on two opposite inner lateral walls thereof adjacent to the mounting hole 212, a plurality of protruding plates 214 protruded from an inner bottom wall thereof and aimed at the mounting hole 212 (see FIG. 3), and an engagement bottom protrusion 215 downwardly curved from an outer bottom wall near one end thereof.

Figure 3:
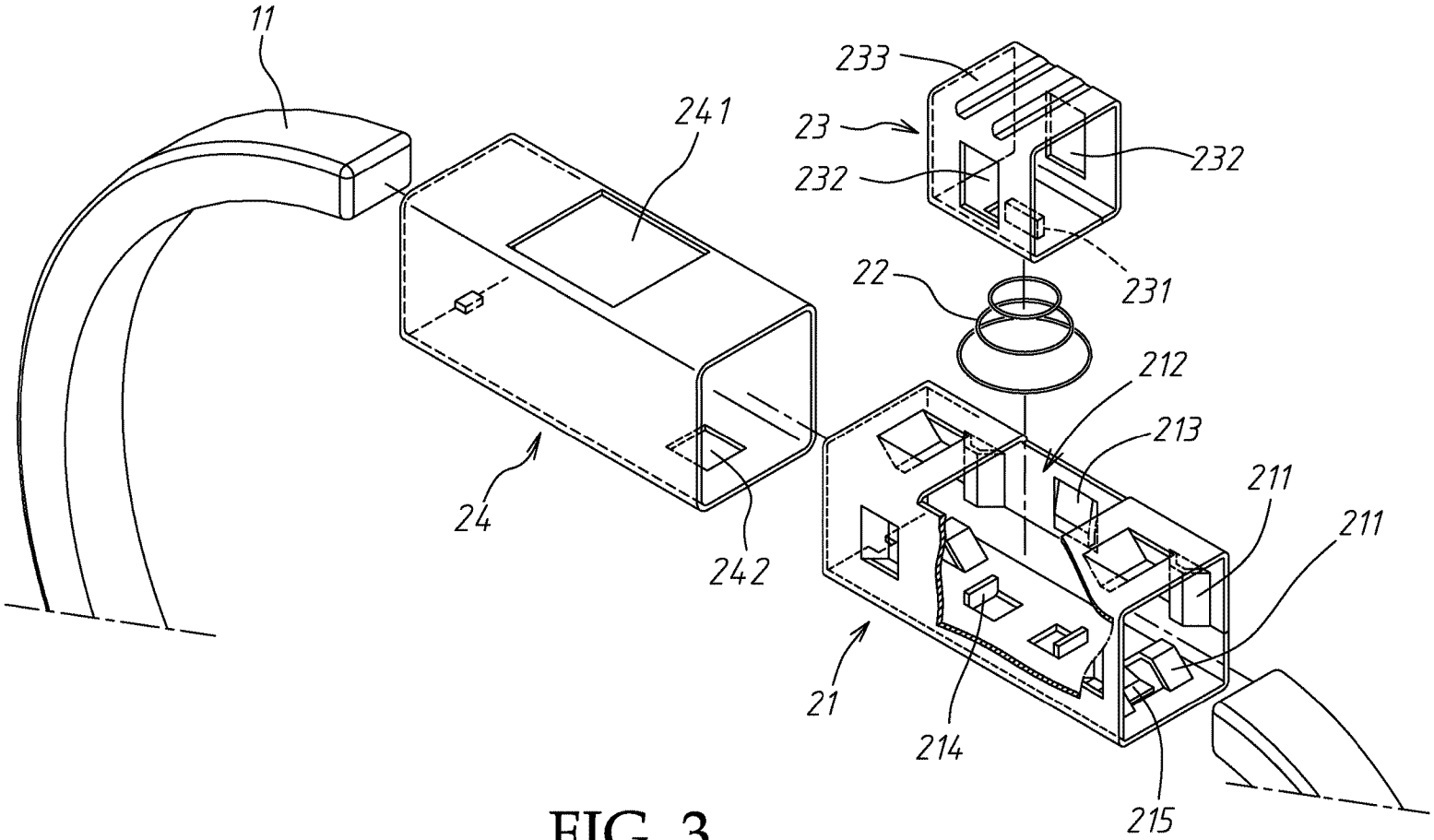
FIG. 3 is an exploded, partially sectional elevation of the press control key ring in accordance with the present invention.

Referring to FIG. 2 again, the locking module 2 further comprises an elastic member 22. In this embodiment, the elastic member 22 is a spring inserted through the mounting hole 212 into the inside of the inner casing 21, having one end thereof elastic member 22 retained in place by the protruding plates 214. The locking module 2 further comprises a press block 23. In this embodiment, the press block 23 is a hollow block of double open-end design inserted through the mounting hole 212 into the inside of the inner casing 21. After insertion of the press block 23 into the inside of the inner casing 21, the two opposite open ends of the press block 23 are disposed in communication with the two opposite open ends of the inner casing 21. As illustrated in FIG. 3, the press block 23 comprises a locating block 231 downwardly protruded from a bottom wall thereof and inserted into an opposite end of the elastic member 22 to secure the elastic member 22 and the press block 23 together so that the elastic member 22 can impart elastic restoring energy to the press block 23, at least one, for example two side holes 232 respectively located on two opposite sidewalls thereof and adapted to face toward the respective retaining blocks 213 after accommodation of the press block 23 in the inner casing 21, and a press surface 233 located on a top surface thereof. The locking module 2 further comprises an outer casing 24. The outer casing 24 is a hollow rectangular shell fitting the configuration of the inner casing 21 and adapted for attaching onto the inner casing 21. The two opposite ends of the outer casing 24 are open ends for the insertion of the inner casing 21 into the inside of the outer casing 24. The outer casing 24 comprises an insertion hole 241 located on the middle of the top wall thereof corresponding to the mounting hole 212 of the inner casing 21 for the insertion of the press block 23, and a locating hole 242 located on a bottom wall near one end thereof. After insertion of the inner casing 21 into the inside of the outer casing 24, the locating hole 242 is forced into engagement with the engagement bottom protrusion 215 to secure the outer casing 24 and the inner casing 21 firmly together.

Figure 4:
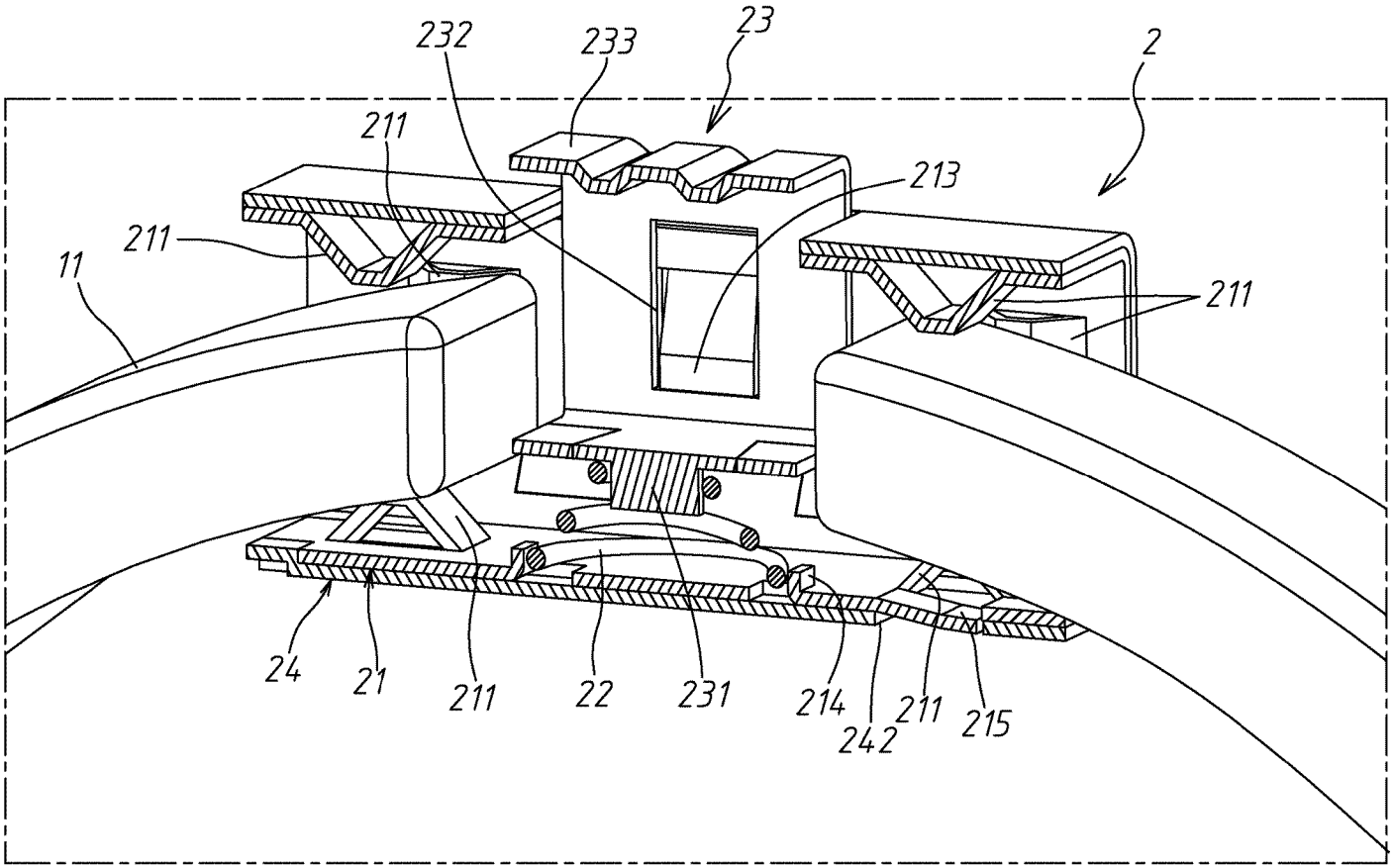
FIG. 4 is a schematic operational view of the press control key ring in accordance with the present invention (I).
Figure 5:
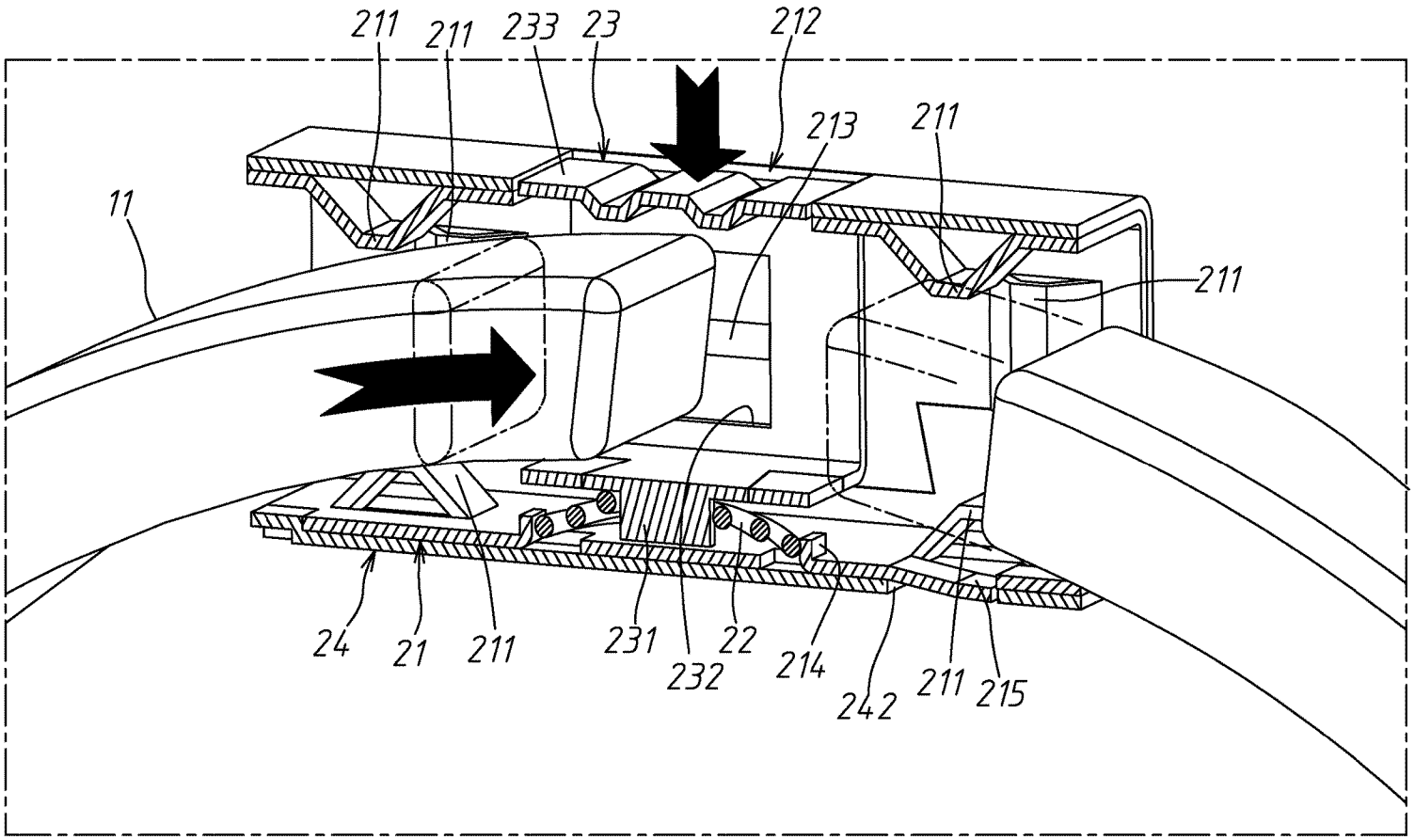
FIG. 5 is a schematic operational view of the press control key ring in accordance with the present invention (II).
Figure 6:
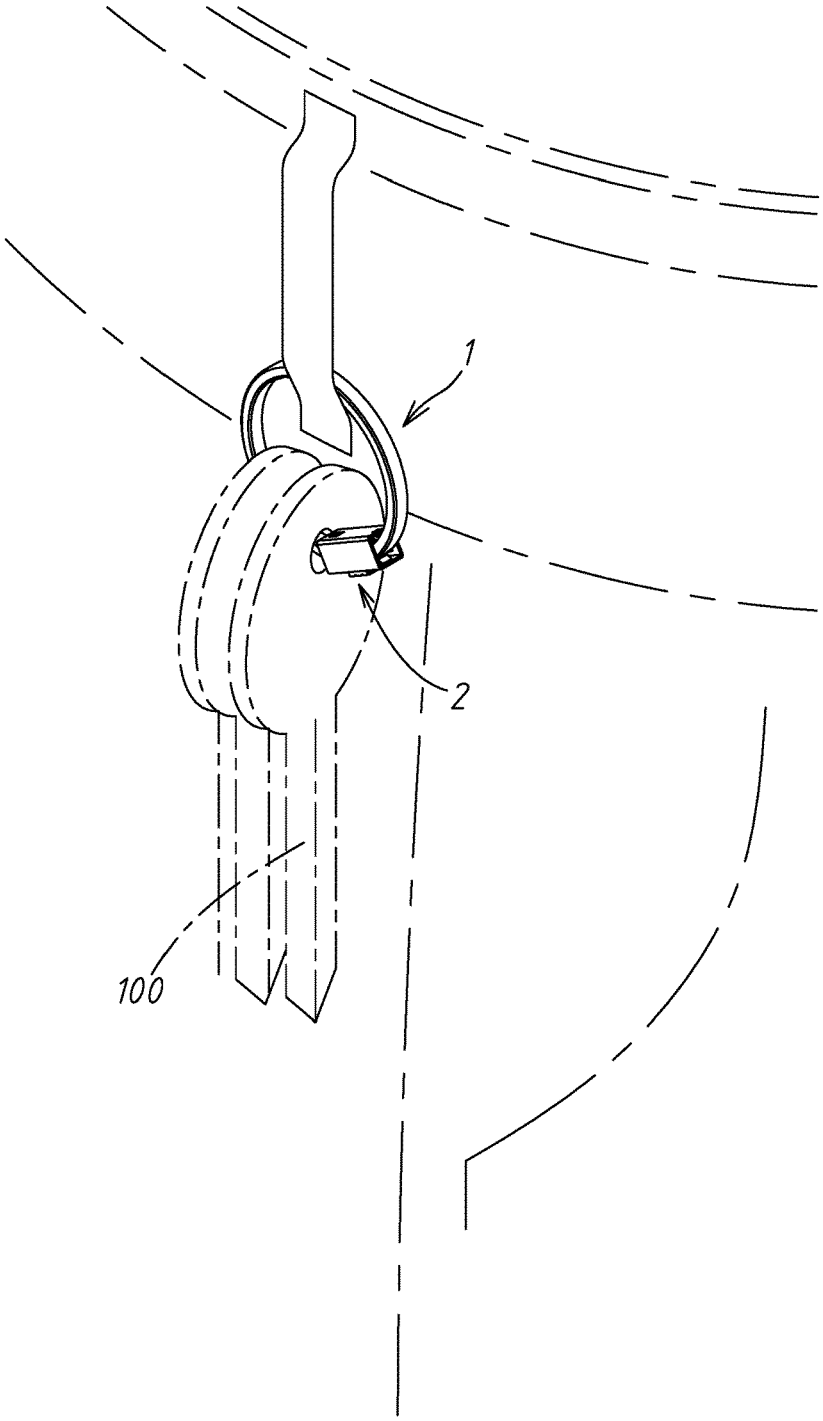
FIG. 6 is a schematic applied view of the present invention.

Referring to FIG. 4, a schematic operational view of the present invention is shown. As illustrated, when the press control key ring is not in use, the locking module 2 is disposed in the opening 12, the two opposite ends of the annular wire rod 11 are respectively disposed in the locking module 2, and the press block 23 of the locking module 2 is forced upward into the mounting hole 212 of the inner casing 21 by the elastic member 22 to stop the annular wire rod 11 from sliding movement relative to the locking module 2. Referring to FIG. 5, when the user presses the press surface 233 to force the press block 23 downwardly away from the mounting hole 212 of the inner casing 21 into the inside of the inner casing 21 and to compress the elastic member 22, the side holes 232 of the press block 23 are retained by the respective retaining blocks 213, keeping the internal space of the press block 23 in alignment and communication with the internal space of the inner casing 21 for allowing sliding movement of the annular wire rod 11 relative to the locking module 2 (see the indication of the arrowhead). At this time, the locking module 2 can be moved out of the opening 12 of the split ring 1 for allowing a key 100 to be mounted to or removed from the annular wire rod 11, as illustrated in FIG. 6.

Figure 7:
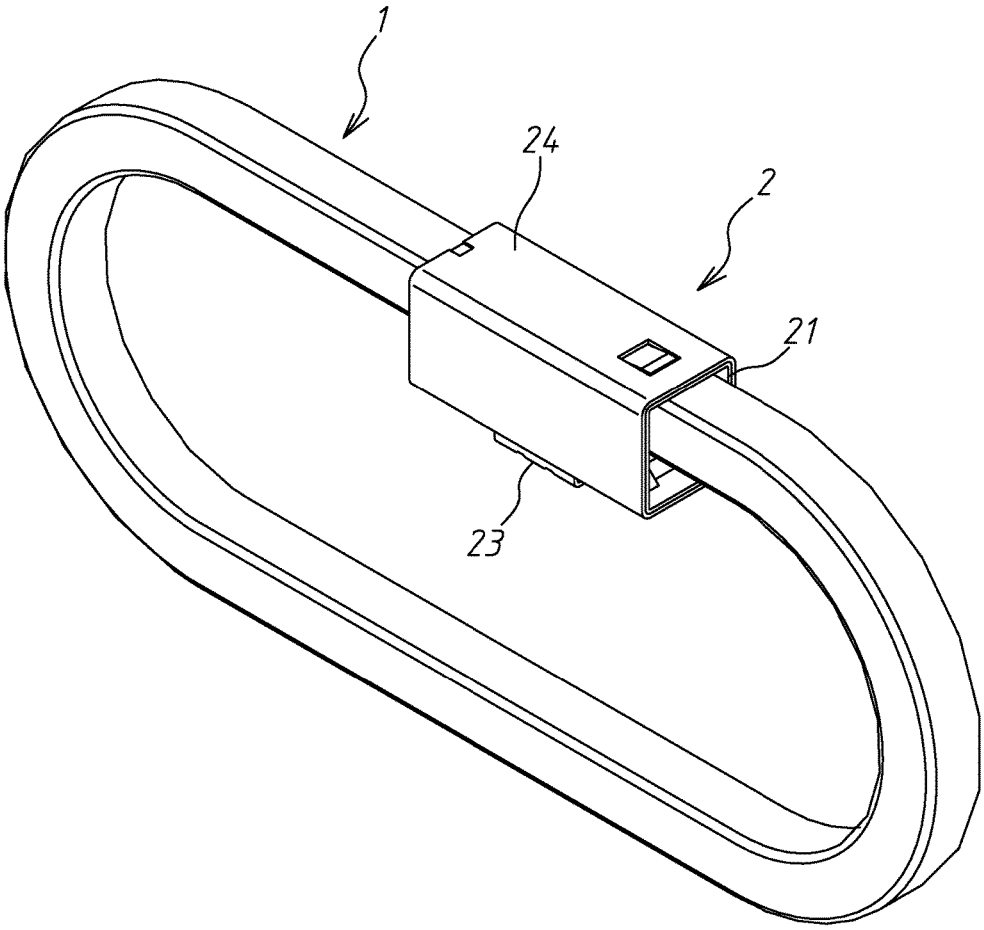
FIG. 7 is an oblique top elevational view of an alternate form of the press control key ring in accordance with the present invention.

Referring to FIG. 7, in an alternate form of the present invention, except the circular profile shown in FIGS. 1-6, the annular wire rod 11 can be configured to exhibit an elliptical profile, increasing the key loading capacity. In this embodiment, the press block 23 of the locking module 2 faces toward the inside of the annular wire rod 11 after installation to avoid being accidentally pressed to drop off.

Figure 8:
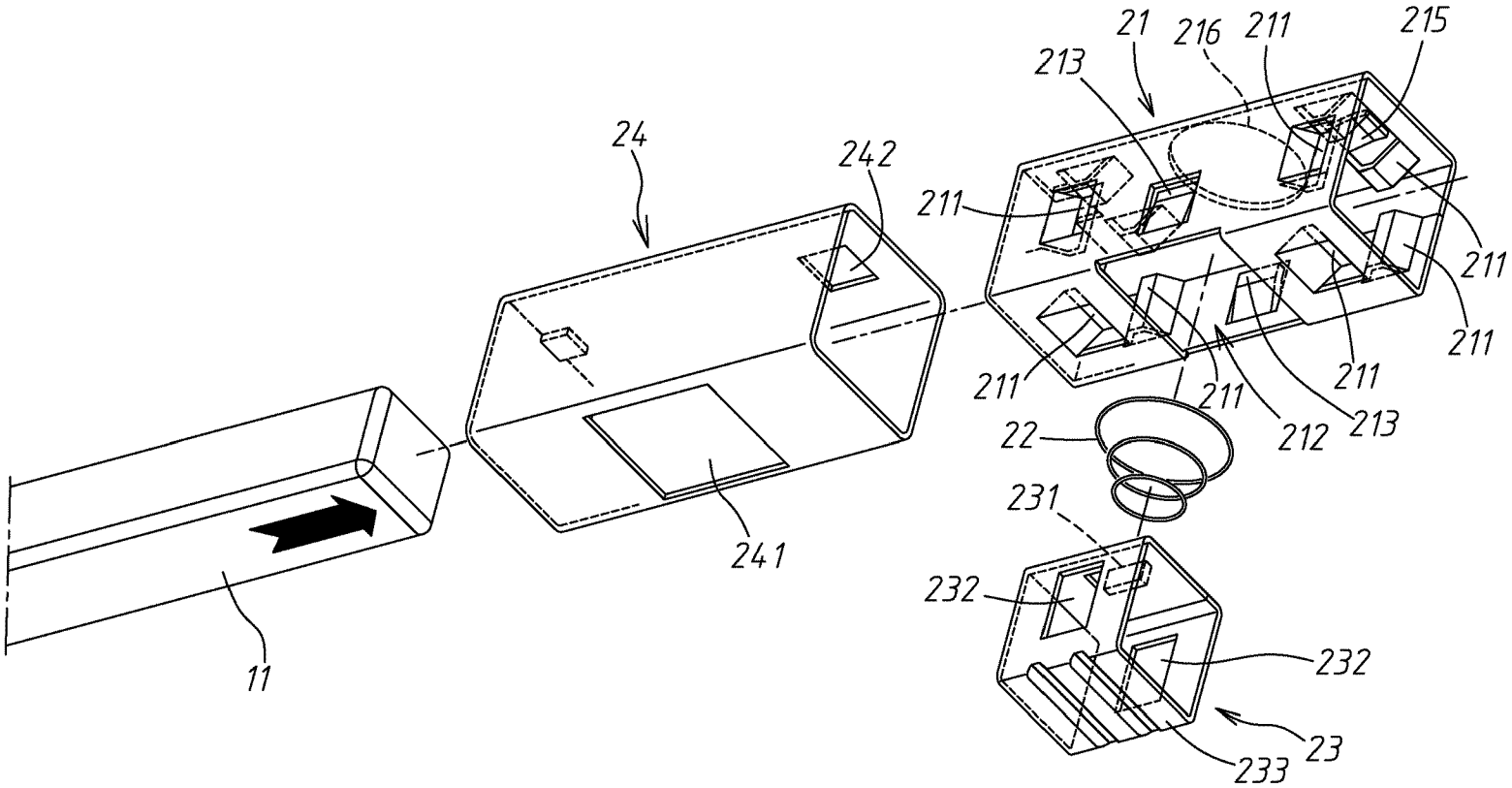
FIG. 8 is an exploded view of the alternate form of the press control key ring in accordance with the present invention.
Figure 9:
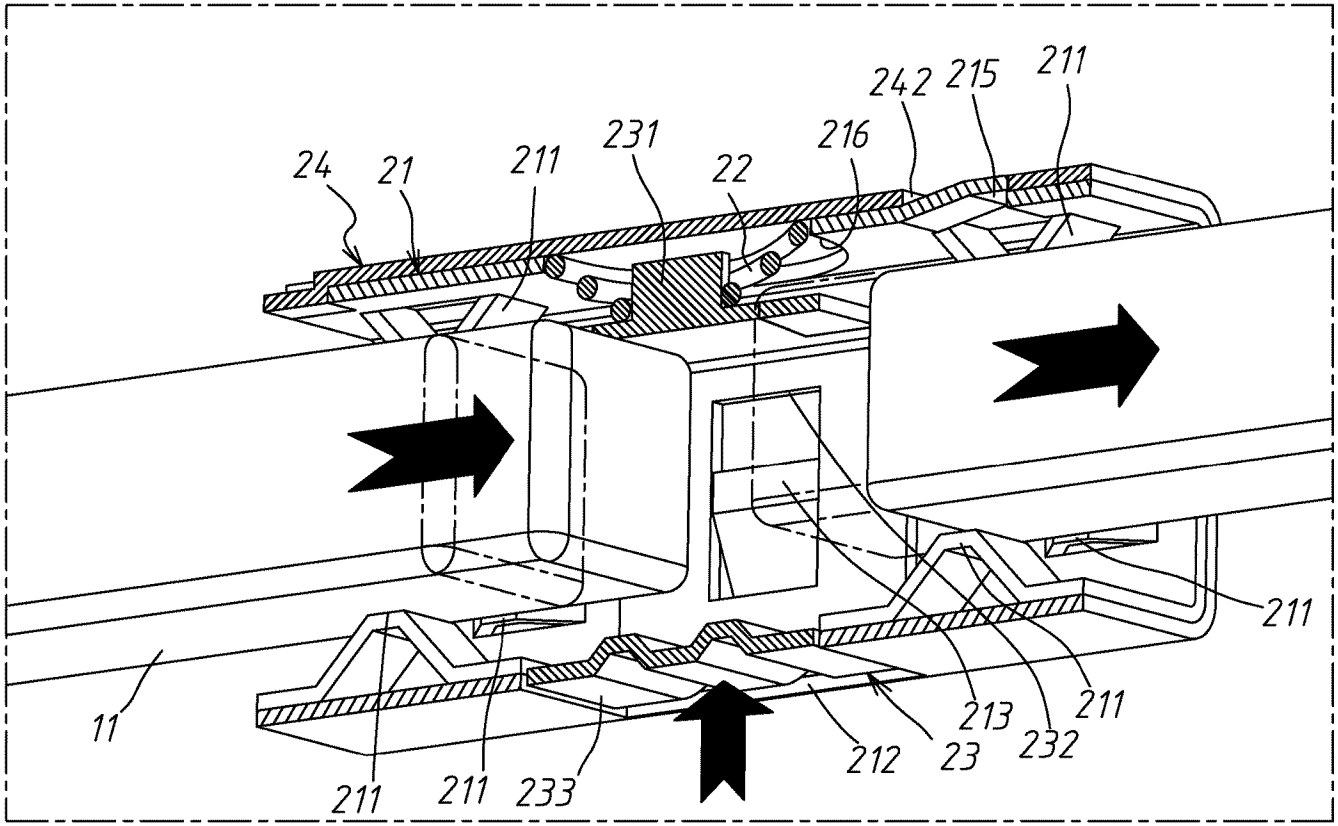
FIG. 9 is a schematic operational view of the alternate form of the press control key ring in accordance with the present invention.

Referring to FIG. 8, in the alternate form of the present invention, the inner casing 21 comprises a positioning recess 216 located on the inner bottom wall thereof and disposed to face toward the mounting hole 212 for the positioning of one end of the elastic member 22. As illustrated in FIG. 9, when the user presses the press surface 233 to force the press block 23 into the inside of the inner casing 21 and to simultaneously compress the elastic member 22, the side holes 232 of the press block 23 are retained by the respective retaining blocks 213. At this time, the internal space of the press block 23 is kept in alignment and communication with the internal space of the inner casing 21 for allowing sliding movement of the annular wire rod 11 in the locking module 2 (see the indication of the arrowhead), thus, the locking module 2 can be moved out of the opening 12 of the split ring 1 for allowing a key 100 to be mounted to or removed from the annular wire rod 11.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A press control key ring, comprising a split ring formed of an annular wire rod, defining an opening between two opposite ends thereof for the insertion of a key to be held; and a locking module mounted in said opening of said split ring and operable to close/open said opening, said locking module comprising:

an inner casing in the form of a hollow shell having two opposite open ends for allowing the two opposite ends of said annular wire rod to be inserted into said inner casing, said inner casing comprising a plurality of supporting blocks disposed in each of the two opposite open ends thereof for supporting sliding movement of said annular wire rod in said locking module, a mounting hole located on the middle of a top wall thereof, a plurality of retaining blocks respectively symmetrically located on two opposite inner lateral walls thereof adjacent to said mounting hole, and an engagement bottom protrusion downwardly curved from an outer bottom wall near one end thereof;

an elastic member mounted in said inner casing, said elastic member having one end thereof fastened to said inner bottom wall of said inner casing;

a press block being a hollow shell having two opposite open ends and mounted in said inner casing through said mounting hole with the two opposite open ends thereof disposed in communication with the inside space of said inner casing, said press block comprising a locating block downwardly protruded from a bottom wall thereof and inserted into an opposite end of said elastic member to secure said elastic member and said press block together, a plurality of side holes respectively located on two opposite sidewalls thereof and adapted to face toward the respective said retaining blocks after accommodation of said press block in said inner casing; and an outer casing sleeved onto said inner casing, said outer casing being a hollow shell having two opposite open ends for the insertion of said inner casing into said outer casing, said outer casing comprising an insertion hole located on the middle of a top wall thereof corresponding to said mounting hole of said inner casing for the insertion of said press block, and a locating hole located on a bottom wall near one end thereof for engagement with said engagement bottom protrusion to secure said outer casing and said inner casing firmly together after insertion of said inner casing into said outer casing.

2. The press control key ring as claimed in claim 1, wherein said annular wire rod is selectively configured to exhibit a circular or elliptical profile.

3. The press control key ring as claimed in claim 1, wherein said retaining blocks exhibit a barbed shape.

4. The press control key ring as claimed in claim 1, wherein said inner casing further comprises a plurality of protruding plates protruded from an inner bottom wall thereof and aimed at said mounting hole for securing one end of said elastic member.

5. The press control key ring as claimed in claim 1, wherein said inner casing comprises a positioning recess located on an inner bottom wall thereof and disposed to face toward said mounting hole for the positioning of the said one end of said elastic member.

6. The press control key ring as claimed in claim 1, wherein said press block further comprises a press surface located on a top side thereof.

7. The press control key ring as claimed in claim 6, wherein said press surface of said press block of said locking module faces toward the inside of said annular wire rod.

* * * * *